US005666634A

United States Patent [19]

Unami et al.

[11] Patent Number: 5,666,634

[45] Date of Patent: Sep. 9, 1997

[54] ALLOY STEEL POWDERS FOR SINTERED BODIES HAVING HIGH STRENGTH, HIGH FATIGUE STRENGTH AND HIGH TOUGHNESS, SINTERED BODIES, AND METHOD FOR MANUFACTURING SUCH SINTERED BODIES

[75] Inventors: Shigeru Unami; Osamu Furukimi, both of Chiba, Japan

[73] Assignee: Kawasaki Steel Corporation, jpx

[21] Appl. No.: 360,762

[22] PCT Filed: Aug. 12, 1993

[86] PCT No.: PCT/JP93/01141

§ 371 Date: Dec. 23, 1994

§ 102(e) Date: Dec. 23, 1994

[87] PCT Pub. No.: WO94/27764

PCT Pub. Date: Dec. 8, 1994

[30] Foreign Application Priority Data

Jun. 2, 1993 [JP] Japan ..... 5-131536

[51] Int. Cl.[6] ..... B22F 3/12; B22F 5/08; C22C 1/04; C22C 33/02

[52] U.S. Cl. ..... 419/11; 419/26; 419/29; 419/32; 419/38; 419/25; 75/255; 75/246; 75/950

[58] Field of Search ..... 419/11, 26, 29, 419/32, 38, 25; 75/255, 246, 950

[56] References Cited

U.S. PATENT DOCUMENTS

| | | | |
|---|---|---|---|
| 4,069,044 | 1/1978 | Mocarski et al. | 75/243 |
| 4,266,974 | 5/1981 | Nitta et al. | 75/251 |
| 4,437,891 | 3/1984 | Umino et al. | 75/251 |
| 4,494,988 | 1/1985 | Schumacher et al. | 75/128 A |
| 4,954,117 | 9/1990 | Takajo et al. | 75/246 |
| 5,427,600 | 6/1995 | Itoh et al. | 75/232 |
| 5,462,577 | 10/1995 | Ogura et al. | 75/345 |
| 5,534,045 | 7/1996 | Ogura et al. | 75/243 |
| 5,552,109 | 9/1996 | Shivanath et al. | 419/53 |

FOREIGN PATENT DOCUMENTS

| | | |
|---|---|---|
| 58-10962 | 2/1983 | Japan . |
| 58-107469 | 6/1983 | Japan . |
| 63-47302 | 2/1988 | Japan . |
| 63-33541 | 2/1988 | Japan . |
| 63-45348 | 2/1988 | Japan . |
| 4-165002 | 6/1992 | Japan . |

OTHER PUBLICATIONS

ASM Handbook, vol. 7, Powder Metallurgy, 1984 pp. 100–104.

*Primary Examiner*—Charles T. Jordan
*Assistant Examiner*—Daniel Jenkins
*Attorney, Agent, or Firm*—Austin R. Miller

[57] ABSTRACT

The invention has for its object the provision alloy steel powders for Cr-based high strength sintered bodies having high tensile strength, fatigue strength and toughness which are adapted for use in parts for motor vehicles and parts for OA apparatus.

The composition of the alloy steel powder comprises, by wt %, not larger than 0.1% of C, not larger than 0.08% of Mn, 0.5–3% of Cr, 0.1–2% of Mo, not larger than 0.01% of S, not larger than 0.01% of P, not larger than 0.2% of O, optionally one or more of 0.2~2.5% Ni, 0.5~2.5% Cu and the balance being inevitable impurities and Fe. The sintered body has substantially the same composition provided that the content of C alone is limited to 0.2–1.2%.

The manufacturing method comprises molding the above alloy steel powder, sintering the resulting green compact at a temperature of 1100°–1300° C. and immediately cooling at a cooling rate of 10°–200° C./minute. The sintered product may be further subjected to carburization and heat-treatments.

30 Claims, 2 Drawing Sheets

ALLOY STEEL POWDERS FOR SINTERED BODIES HAVING HIGH STRENGTH, HIGH FATIGUE STRENGTH AND HIGH TOUGHNESS, SINTERED BODIES, AND METHOD FOR MANUFACTURING SUCH SINTERED BODIES

TECHNICAL FIELD

This invention relates to the art of powder metallurgy and more particularly, to alloy steel powders used to make sintered bodies which have high strength, high fatigue strength and high toughness, sintered bodies, and a method for manufacturing the sintered bodies.

BACKGROUND ART

In general, the sintered body made by powder metallurgy is advantageous in cost over ingot steels obtained through forging and rolling steps and has wide utility as parts of motor vehicles and office automation apparatus. However, the sintered body has voids which are inevitably formed during the course of its fabrication, thus leading to the drawback that strength, fatigue strength and toughness are low. In order to enlarge the range in use of the sintered body, it is important to improve the strength, fatigue strength and toughness.

In order to improve the strength of sintered body, Cr-Mn alloy steel powder has been hitherto used (Japanese Patent Publication No. 58-10962). Although Cr and Mn serve to increase hardenability and thus, have the merit of high strength after heat treatment, they are, respectively, ready-to-oxidize elements, with the attendant drawback that Cr—Mn composite oxide is formed to lower the fatigue strength and toughness of the resultant sintered body.

To avoid this, it is essential for the manufacture of Cr—Mn alloy sintered bodies to sinter and reduce in an atmosphere where an oxygen content is small and to use a specific type of vacuum reduction furnace.

The present applicant has already developed (Japanese Patent Laid-open No. 4-165002) a Cr alloy steel powder wherein the content of Mn is reduced and to which Nb and V are added. Since the Mn content is reduced, the severeness of the sintering atmosphere can be mitigated and the sintering may be effected not only in vacuum, but also in an atmosphere of $N_2$ and/or $H_2$. Accordingly, ordinarily employed sintering furnaces are sufficient for this purpose. However, according to the further investigations made by us, it has been found that the Cr-based alloy steel powder is disadvantageous in that the sintered body is increased in strength through the precipitation of carbides and/or nitrides of Nb and V, so that the fatigue strength and toughness lower owing to the existence of the carbides and nitrides which act as sites of fracture.

Where iron parts for which high strength is required are fabricated according to the powder metallurgical technique, it is usual to obtain necessary characteristics by a procedure which comprises sintering an alloy steel powder that is a mixture of pure iron powder and alloy element powders, or a green compact of the alloy steel powder and then subjecting to carburizing or nitriding treatment, followed by thermal treatments such as quenching and tempering. Accordingly, using the fabrication procedure, it is unavoidable to increase the fabrication costs and lower the dimensional accuracy owing to the thermal treatments.

To avoid this, Japanese Patent Laid-open No. 63-45348 discloses a technique wherein sintering activating powder and graphite powder are mixed with an alloy steel and the mixture is molded and preheated. Subsequently, the preheated mixture is sintered at 1140°–1200° C. and cooled at a cooling rate of 20°–120° C./minute to 200° C. The method set out in the Japanese Patent Laid-open No. 63-45348 has the problem that since the sintering activating powder is mixed, the compressibility of a green compact lowers and that the structural uniformity of the sintered product is not high, with the sintered body having a varying dimensional accuracy.

Japanese Patent Laid-open No. 63-33541 proposes a method wherein an alloy steel powder whose contents of C, Si, P, S, N and O are reduced and to which Ni, Cr and Mo are added is sintered at 1100°–1350° C. and, after sintering, cooled at a cooling rate of 0.15° C./second to obtain a sintered body having a strength not smaller than 110 kgf/mm$^2$. However, since the alloy powder contains 3.0–4.5% of Cr, there arises the problems that oxides are liable to form, that the compressibility at the time of molding is poor and that the sintered body does not increase in strength.

As shown in the examples set forth in this application, the alloy steel powder inevitably contains 0.13–0.18% of Mn and P, S are present in amounts not smaller than 0.01%. The resultant sintered body has inconveniently low fatigue strength and toughness.

The invention has for its object the provision of alloy steel powders used to manufacture sintered bodies and also of sintered bodies obtained therefrom, which overcome the hitherto known problems involved by sintered bodies as set out hereinabove and which ensure sintered bodies having high strength, high fatigue strength and high toughness.

The invention also has as another object the provision of a method for manufacturing a high strength iron sintered body, as will not be obtained only by prior art sintering, in high dimensional accuracy and in a relatively inexpensive manner while omitting thermal treatments.

DISCLOSURE OF THE INVENTION

The invention provides an alloy steel powder for sintered bodies having high strength, high fatigue strength and high toughness, which is characterized by comprising, by wt %, not larger than 0.1% of C, not larger than 0.08% of Mn, 0.5–3% of Cr, 0.1–2% of Mo, not larger than 0.01% of S, not larger than 0.01% of P, not larger than 0.2% of O, optionally one or more of 0.2–2.5% of Ni, 0.5–2.5% of Cu, 0.001–0.004% of Nb and 0.001–0.004% of V, and the balance being inevitable impurities and Fe. The invention also provides a sintered body having high strength, high fatigue strength and high toughness, which is characterized by comprising, by wt %, 0.2–1.2% of C, not larger than 0.08% of Mn, 0.5–3% of Cr, 0.1–2% of Mo, not larger than 0.01% of S, not larger than 0.01% of P, not larger than 0.2% of O, optionally one or more of 0.2–2.5% of Ni, 0.5–2.5% of Cu, 0.001–0.004% of Nb and 0.001–0.004% of V, and the balance being inevitable impurities and Fe.

Moreover, the invention provides a method for manufacturing a high strength iron-based sintered body, characterized by molding an alloy steel powder comprised of 0.5–3.0% of Cr, 0.1–2.0% of Mo, not larger than 0.08% of Mn and the balance being Fe and inevitable impurities, sintering the resulting green compact at a temperature of 1100°–1300° C., and immediately cooling the sintered compact at a cooling rate of 10°–200° C./minute.

The alloy steel powder of the invention can be readily produced by subjecting an ingot steel prepared to have the above-defined composition to any known water-atomizing method.

The sintered body of the invention can also be readily produced by adding an intended amount of graphite powder to an alloy steel powder, admixing a lubricant such as zinc stearate powder with the mixture, and subjecting the resulting mixture to compression molding and then to sintering. The sintered body may be further carburized, followed by oil quenching and tempering.

The reasons why the respective components in the alloy steel powder and sintered body of the invention are limited within certain ranges are described.

The reason why C in the alloy steel powder is not larger than 0.1% is that C is an element which serves to harden the ferrite matrix through formation of a solid solution as penetrated in the steel. If the content exceeds 0.1 wt % (hereinafter referred to simply as %), the powder is hardened considerably, with a lowering of the compressibility of the green compact.

The content of C in the sintered body ranges 0.2–1.2%. This is because C is an element for improving the steel strength. To this end, the content of C in the sintered body should not be less than 0.2%. When the content exceeds 2.0%, cementite precipitates to lower the strength and toughness.

The component C is added to the sintered body by mixing of graphite powder with the alloy steel powder of the invention or by subjecting to carburization treatment to permit C to be left in the sintered body. Where the carburization treatment is effected, C may be distributed in a varying concentration in the sintered body. This will be avoided when the total amount is in the range of 0.2–1.2%.

The limited amounts of the following components are common to both the alloy steel powder and the sintered body.

The component Mn improves the strength of steel by improving hardenability and through solution hardening. However, if Mn is contained over 0.08%, its oxide is formed in large amounts. The oxide serves as sites of fracture, thereby lowering the fatigue strength and toughness of the resultant sintered body. Accordingly, the content should be not larger than 0.08%. For the reduction in amount of Mn, a specific treatment is used to reduce the content of Mn to a level not larger than 0.08% during the course of the steel making.

The component Cr has the effect of improving the hardenability of a sintered body and also of improving the tensile strength and fatigue strength. In addition, Cr serves to increase hardness after thermal treatment and is effective in improving a wear resistance. To obtain such effects as set out above, the content should not be less than 0.5%. However, the sintered body is formed from powder materials, under which when Cr is contained in amounts exceeding 3%, oxides are formed in large amounts. The oxides serve as fatigue breaking sites at fatigue fracture to lower the fatigue strength. Accordingly, the content ranges 0.3–5%.

The component Mo serves to improve the strength of steel through the improvement of hardenability and also through solution and precipitation hardening. If the content is less than 0.1%, the improving effect is small. If over 2%, the toughness lowers. Thus, the content ranges 0.1–2%.

The reduction in amount of S is one of features of the invention. By reducing the Mn content to not larger than 0.08%, MnS is reduced in amount with an increasing amount of solid solution S. When the content of S exceeds 1%, the solid solution S increases, resulting in a lowering of a boundary strength. Accordingly, the content is not larger than 0.01%.

The reduction in amount of P is also one of features of the invention. If the contents of Mn and S are both great, the toughness suffers little influence. However, the content of Mn is not larger than 0.08% and the content of S is not larger than 0.01%, under which when the content of P is set at a level not larger than 0.01%, the boundary strength increases with toughness being improved. Accordingly, the content should be not larger than 0.01%.

The component O serves to largely influence on the mechanical strength of the sintered body. The smaller its amount, the more it is preferable. The amount not more than 0.05% is specifically preferable. If the content exceeds 0.2%, large amount of the oxides are generated. Accordingly, the content is not more than 0.2%.

The component Ni serves to improve the strength and toughness of steel through the improvement of hardenability and the solution hardening. If the content is less than 0.2%, the improving effect is not significant. If over 2.5%, austenite is formed in excess, resulting in a lowering of strength. Accordingly, the content ranges 0.2–2.5%.

The component Cu serves to improve the strength of steel through the improvement of hardenability and the solution hardening. If the content is less than 0.5%, the improving effect is not significant. If over 2.5%, toughness is lowered. Accordingly, the content ranges 0.5–2.5%.

When Nb and V are, respectively, added in amounts exceeding 0.004%, coarse carbides and/or nitrides serve as sites from which the resultant sintered body is broken, resulting in a lowering of toughness. In the range of 0.001–0.004%, fine carbides and/or nitrides are formed but do not serve as breaking sites.

The production conditions of the sintered body are then described. At a temperature lower than 1100° C., sintering does not proceed satisfactorily. At a high temperature over 1300° C., sintering costs undesirably increase. Thus, the sintering temperature ranges 1100°–1300° C.

The cooling rate is one of important features of the invention after sintering. The sintered body within a compositional range of the invention has a pearlite structure when the quenching rate is less than 10° C./minute. Over 200° C./minute, the structure is converted to a coarse bainite structure, resulting in a lower of strength. Accordingly, the cooling rate in the method of the invention is in the range of 10°–200° C./minute, under which the resulting sintered body has a fine pearlite structure with its strength being improved. Preferably, the cooling rate ranges 10°–50° C./minute.

In the practice of the invention, the compositions of the alloy steel powder and the sintered body are so limited as set out hereinabove, by which the toughness is improved in the form of a sintered body and sites of fatigue fracture are reduced in number with the result that the fatigue strength is improved. The tensile strength of a sintered body is satisfactorily improved by incorporation of Cr, Mo and the like.

EXAMPLES

Example 1

Figure 1:
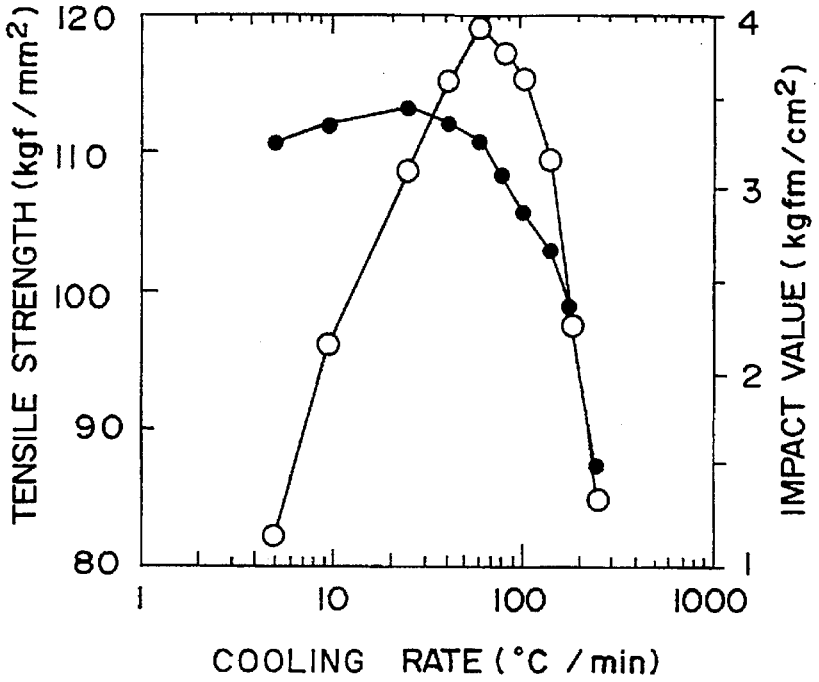
FIG. 1 is a characteristic view showing the relation between the tensile strength and the cooling rate of sintered bodies obtained after sintering an alloy steel powder.

Alloy steel powders were prepared from molten steel having difference chemical components according to a water-atomizing method. These powders were subjected to chemical analysis after final reduction. The results are shown in Table 1. Graphite powder, being 0.15 wt %, and 1 wt % of zinc stearate powder were added to the respective alloy steel powders of Table 1, followed by compacting to obtain green compacts having a density of 7.10 g/cm$^2$. These green compacts were, respectively, sintered in an atmosphere of 90% $N_2$-10% $H_2$ under conditions of 1250° C. and 60 minutes, followed by carburizing treatment (a carbon potential in the atmosphere of 0.9%) at 890° C. for 120 minutes, then oil-quenching and tempering at 150° C. for 60 minutes. The resultant carburized, heat-treated sintered and carburized bodies were, respectively, to measurements of tensile strength, fatigue strength and a Sharpy impact value. The test results are shown in Table 2. As will become apparent from Table 2, the bodies of the invention exhibit good tensile strength, fatigue strength and Sharpy impact value of not smaller than 125 kgf/mm$^2$, not smaller than 45 kgf/mm$^2$ and not smaller than 1.0 kgf·m/cm$^2$, respectively. The endurance fatigue strength was a stress which was determined by use of the Ono-type rotary bending tester wherein the stress corresponded to the number of cycles of $10^7$ determined from a stress-number of cycle curve. The Sharpy impact value was determined without notch at room temperature.

TABLE 1

| | Chemical Component(wt %) | | | | | | | | | |
|---|---|---|---|---|---|---|---|---|---|---|
| Sample No. | C | Mn | Cr | Mo | S | P | O | Ni | Cu | Remarks |
| 1 | 0.005 | 0.04 | 1.03 | 0.92 | 0.005 | 0.004 | 0.08 | — | — | Inventive Example |
| 2 | 0.005 | 0.07 | 1 | 0.92 | 0.004 | 0.005 | 0.07 | — | — | Inventive Example |
| 3 | 0.008 | 0.02 | 0.64 | 0.9 | 0.005 | 0.004 | 0.07 | — | — | Inventive Example |
| 4 | 0.008 | 0.03 | 2.05 | 0.93 | 0.005 | 0.004 | 0.07 | — | — | Inventive Example |
| 5 | 0.003 | 0.02 | 1.02 | 0.32 | 0.004 | 0.005 | 0.08 | — | — | Inventive Example |
| 6 | 0.007 | 0.03 | 0.99 | 1.48 | 0.005 | 0.005 | 0.08 | — | — | Inventive Example |
| 7 | 0.006 | 0.04 | 1.01 | 0.89 | 0.008 | 0.004 | 0.07 | — | — | Inventive Example |
| 8 | 0.006 | 0.03 | 1.02 | 0.9 | 0.004 | 0.009 | 0.09 | — | — | Inventive Example |
| 9 | 0.005 | 0.03 | 1.03 | 0.89 | 0.005 | 0.004 | 0.08 | 0.6 | — | Inventive Example |
| 10 | 0.005 | 0.04 | 0.98 | 0.92 | 0.004 | 0.004 | 0.08 | 2.1 | — | Inventive Example |
| 11 | 0.006 | 0.03 | 1.02 | 0.9 | 0.004 | 0.004 | 0.08 | — | 0.6 | Inventive Example |
| 12 | 0.005 | 0.02 | 1.01 | 0.91 | 0.004 | 0.005 | 0.07 | — | 2.3 | Inventive Example |
| 13 | 0.006 | 0.03 | 1.02 | 0.89 | 0.004 | 0.005 | 0.08 | 0.6 | 0.6 | Inventive Example |
| 14 | 0.11* | 0.03 | 0.99 | 0.91 | 0.005 | 0.004 | 0.06 | — | — | Comparative Example |
| 15 | 0.002 | 0.12* | 1.01 | 0.9 | 0.004 | 0.005 | 0.09 | — | — | Comparative Example |
| 16 | 0.003 | 0.02 | 0.42* | 0.88 | 0.004 | 0.005 | 0.08 | — | — | Comparative Example |
| 17 | 0.003 | 0.02 | 3.5* | 0.91 | 0.004 | 0.004 | 0.08 | — | — | Comparative Example |
| 18 | 0.004 | 0.03 | 1.03 | 0.08* | 0.005 | 0.005 | 0.08 | — | — | Comparative Example |
| 19 | 0.004 | 0.04 | 1.01 | 2.6* | 0.004 | 0.005 | 0.08 | — | — | Comparative Example |
| 20 | 0.006 | 0.03 | 1.01 | 0.92 | 0.02* | 0.004 | 0.07 | — | — | Comparative Example |
| 21 | 0.007 | 0.04 | 1 | 0.9 | 0.005 | 0.022* | 0.07 | — | — | Comparative Example |
| 22 | 0.002 | 0.03 | 1.02 | 0.92 | 0.005 | 0.004 | 0.25* | — | — | Comparative Example |
| 23 | 0.004 | 0.04 | 1.03 | 0.91 | 0.005 | 0.005 | 0.07 | 2.6* | — | Comparative Example |
| 24 | 0.005 | 0.02 | 1.02 | 0.89 | 0.005 | 0.005 | 0.08 | — | 2.7* | Comparative Example |

TABLE 1-continued

| Sample | Chemical Component(wt %) | | | | | | | | | | | |
|---|---|---|---|---|---|---|---|---|---|---|---|---|
| No. | C | Mn | Cr | Mo | S | P | O | Ni | Cu | Nb | V | Remarks |
| 25 | 0.004 | 0.05 | 1.02 | 0.34 | 0.008 | 0.003 | 0.07 | — | — | 0.003 | — | Inventive Example |
| 26 | 0.005 | 0.05 | 1.10 | 0.35 | 0.007 | 0.005 | 0.08 | — | — | — | 0.002 | Inventive Example |
| 27 | 0.006 | 0.04 | 1.02 | 0.33 | 0.008 | 0.007 | 0.06 | — | — | 0.002 | 0.003 | Inventive Example |
| 28 | 0.003 | 0.04 | 0.98 | 0.32 | 0.006 | 0.005 | 0.07 | 0.31 | 0.49 | 0.003 | — | Inventivr Example |
| 29 | 0.003 | 0.04 | 1.08 | 0.34 | 0.004 | 0.006 | 0.08 | 0.30 | 0.51 | — | 0.002 | Inventive Example |
| 30 | 0.005 | 0.05 | 1.00 | 0.35 | 0.008 | 0.005 | 0.06 | 0.31 | 0.50 | 0.002 | 0.003 | Inventive Example |
| 31 | 0.005 | 0.05 | 1.05 | 0.36 | 0.005 | 0.007 | 0.08 | — | — | 0.005* | 0.008* | Comparative Example |

*Outside the scope of the invention.

TABLE 2

| Sample | Chemical Components of Sintered Body (wt %) | | | | | | | | | Tensile Strength | Fatigue Strength | Impact Strength (Kgf · m/ | |
|---|---|---|---|---|---|---|---|---|---|---|---|---|---|
| No. | C | Mn | Cr | Mo | S | P | O | Ni | Cu | (Kgf/mm$^2$) | (Kgf/mm$^2$) | mm$^2$) | Remarks |
| 1 | 0.4 | 0.04 | 1.03 | 0.92 | 0.002 | 0.002 | 0.06 | — | — | 137 | 53 | 1.4 | Inventive Example |
| 2 | 0.39 | 0.07 | 1 | 0.92 | 0.001 | 0.003 | 0.06 | — | — | 136 | 51 | 1.2 | Inventive Example |
| 3 | 0.41 | 0.02 | 0.64 | 0.9 | 0.001 | 0.003 | 0.05 | — | — | 126 | 45 | 1.6 | Inventive Example |
| 4 | 0.3 | 0.03 | 2.05 | 0.93 | 0.001 | 0.002 | 0.06 | — | — | 130 | 50 | 1.3 | Inventive Example |
| 5 | 0.39 | 0.02 | 1.02 | 0.32 | 0.001 | 0.003 | 0.07 | — | — | 136 | 52 | 1.6 | Inventive Example |
| 6 | 0.35 | 0.03 | 0.99 | 1.48 | 0.001 | 0.003 | 0.06 | — | — | 138 | 53 | 1.5 | Invention Example |
| 7 | 0.42 | 0.04 | 1.01 | 0.89 | 0.007 | 0.002 | 0.05 | — | — | 136 | 53 | 1.3 | Invention Example |
| 8 | 0.4 | 0.03 | 1.02 | 0.9 | 0.002 | 0.008 | 0.08 | — | — | 136 | 52 | 1.3 | Inventive Example |
| 9 | 0.36 | 0.03 | 1.03 | 0.89 | 0.001 | 0.003 | 0.07 | 0.6 | — | 131 | 49 | 1.5 | Inventive Example |
| 10 | 0.34 | 0.04 | 0.98 | 0.92 | 0.001 | 0.003 | 0.06 | 2.1 | — | 133 | 50 | 1.5 | Inventive Example |
| 11 | 0.34 | 0.03 | 1.02 | 0.9 | 0.002 | 0.003 | 0.06 | — | 0.6 | 132 | 50 | 1.5 | Inventive Example |
| 12 | 0.37 | 0.02 | 1.01 | 0.91 | 0.002 | 0.003 | 0.05 | — | 2.3 | 133 | 50 | 1.4 | Inventive Example |
| 13 | 0.37 | 0.03 | 1.02 | 0.89 | 0.002 | 0.003 | 0.06 | 0.6 | 0.6 | 148 | 55 | 1.4 | Inventive Example |
| 14 | 0.51 | 0.03 | 0.99 | 0.91 | 0.001 | 0.002 | 0.05 | — | — | 115 | 39 | 0.5 | Com-parative Example |
| 15 | 0.39 | 0.12* | 1.01 | 0.9 | 0.001 | 0.003 | 0.07 | — | — | 121 | 43 | 0.6 | Com-parative Example |
| 16 | 0.34 | 0.02 | 0.42* | 0.88 | 0.001 | 0.004 | 0.06 | — | — | 116 | 38 | 1.6 | Com-parative Example |
| 17 | 0.31 | 0.02 | 3.5* | 0.91 | 0.002 | 0.003 | 0.07 | — | — | 115 | 37 | 0.7 | Com-parative Example |
| 18 | 0.33 | 0.03 | 1.03 | 0.08* | 0.001 | 0.003 | 0.07 | — | — | 119 | 41 | 1.6 | Com-parative Example |
| 19 | 0.31 | 0.04 | 1.01 | 2.6* | 0.001 | 0.003 | 0.06 | — | — | 118 | 38 | 0.5 | Com-parative Example |
| 20 | 0.4 | 0.03 | 1.01 | 0.92 | 0.018* | 0.003 | 0.05 | — | — | 115 | 38 | 0.3 | Com-parative Example |

TABLE 2-continued

| | | | | | | | | | | | | | |
|---|---|---|---|---|---|---|---|---|---|---|---|---|---|
| 21 | 0.41 | 0.04 | 1 | 0.9 | 0.001 | 0.021* | 0.06 | — | — | 114 | 38 | 0.3 | Comparative Example |
| 22 | 0.34 | 0.03 | 1.02 | 0.92 | 0.001 | 0.002 | 0.23* | — | — | 113 | 37 | 0.4 | Comparative Example |
| 23 | 0.35 | 0.04 | 1.03 | 0.91 | 0.002 | 0.003 | 0.05 | 2.6* | — | 115 | 38 | 0.4 | Comparative Example |
| 24 | 0.38 | 0.02 | 1.02 | 0.89 | 0.001 | 0.003 | 0.07 | — | 2.7* | 118 | 37 | 0.3 | Comparative Example |

| Sample | Chemical Components of Sintered Body (wt %) | | | | | | | | | | | Tensile Strength | Fatigue Strength | Impact Strength (Kgf · m/ | |
|---|---|---|---|---|---|---|---|---|---|---|---|---|---|---|---|
| No. | C | Mn | Cr | Mo | S | P | O | Ni | Cu | Nb | V | (Kgf/mm²) | (Kgf/mm²) | mm²) | Remarks |
| 25 | 0.42 | 0.05 | 1.02 | 0.34 | 0.008 | 0.003 | 0.05 | — | — | 0.003 | — | 125 | 48 | 1.2 | Inventive Example |
| 26 | 0.38 | 0.05 | 1.10 | 0.35 | 0.007 | 0.005 | 0.04 | — | — | — | 0.002 | 126 | 49 | 1.2 | Inventive Example |
| 27 | 0.41 | 0.04 | 1.02 | 0.33 | 0.008 | 0.007 | 0.03 | — | — | 0.002 | 0.003 | 124 | 48 | 1.2 | Inventive Example |
| 28 | 0.4 | 0.04 | 0.98 | 0.32 | 0.006 | 0.005 | 0.03 | 0.31 | 0.49 | 0.003 | — | 131 | 50 | 1.3 | Inventive Example |
| 29 | 0.37 | 0.04 | 1.08 | 0.34 | 0.004 | 0.006 | 0.05 | 0.30 | 0.51 | — | 0.002 | 130 | 50 | 1.3 | Inventive Example |
| 30 | 0.42 | 0.05 | 1.00 | 0.35 | 0.008 | 0.005 | 0.04 | 0.31 | 0.50 | 0.002 | 0.003 | 130 | 49 | 1.3 | Inventive Example |
| 31 | 0.39 | 0.05 | 1.05 | 0.36 | 0.005 | 0.007 | 0.06 | — | — | 0.005 | 0.008 | 126 | 45 | 0.7 | Comparative Example |

*Outside the scope of the invention.

EXAMPLE 2

The alloy steel powders of Table 3 which had been prepared in the same manner as in Example 1 were, respectively, admixed with 0.9 wt % of graphite powder and 1 wt % of zinc stearate powder, followed by compacting to obtain green compacts having a density of 7.0 g/cm$^3$. These compacts were each sintered in 75% $H_2$-25% $N_2$ under conditions of 1250° C. and 60 minutes, followed by cooling at a cooling rate of 20° C./minute. The resultant sintered bodies were subjected to measurements of tensile strength, fatigue strength and Sharpy impact value in the same manner as in Example 1. The test results are shown in Table 4. As will be apparent from Table 4, the examples of the invention exhibit good results that the tensile strength, fatigue strength and Sharpy value are, respectively, not lower than 80 kgf/mm$^2$, not lower than 35 kgf/mm$^2$ and not lower than 2.0 kgf·m/cm$^2$.

TABLE 3

| Sample | Chemical Components (wt %) | | | | | | | | |
|---|---|---|---|---|---|---|---|---|---|
| No. | C | Mn | Cr | Mo | S | P | O | Ni | Cu |
| A | 0.005 | 0.03 | 1.00 | 0.30 | 0.004 | 0.004 | 0.14 | — | — |
| B | 0.005 | 0.08 | 1.01 | 0.31 | 0.004 | 0.005 | 0.13 | — | — |
| C | 0.008 | 0.03 | 0.61 | 0.30 | 0.005 | 0.004 | 0.14 | — | — |
| D | 0.008 | 0.03 | 2.62 | 0.31 | 0.004 | 0.004 | 0.14 | — | — |
| E | 0.005 | 0.04 | 1.02 | 0.90 | 0.004 | 0.005 | 0.13 | — | — |
| F | 0.007 | 0.03 | 0.99 | 1.50 | 0.005 | 0.005 | 0.14 | — | — |
| G | 0.006 | 0.03 | 0.02 | 0.30 | 0.008 | 0.005 | 0.13 | — | — |
| H | 0.006 | 0.03 | 1.02 | 0.30 | 0.005 | 0.008 | 0.14 | — | — |
| I | 0.006 | 0.04 | 1.00 | 0.30 | 0.005 | 0.004 | 0.14 | — | — |
| J | 0.005 | 0.04 | 1.00 | 0.31 | 0.005 | 0.005 | 0.14 | 0.4 | — |
| K | 0.005 | 0.03 | 1.00 | 0.30 | 0.004 | 0.004 | 0.14 | 2.2 | — |
| L | 0.006 | 0.04 | 0.99 | 0.31 | 0.005 | 0.004 | 0.13 | — | 0.6 |
| M | 0.005 | 0.03 | 1.01 | 0.30 | 0.004 | 0.005 | 0.14 | — | 2.2 |
| N | 0.006 | 0.03 | 1.02 | 0.30 | 0.005 | 0.004 | 0.13 | 0.7 | 0.7 |
| O | 0.005 | 0.12* | 1.01 | 0.31 | 0.004 | 0.004 | 0.14 | — | — |
| P | 0.005 | 0.03 | 0.41* | 0.30 | 0.005 | 0.005 | 0.14 | — | — |
| Q | 0.006 | 0.03 | 3.52* | 0.30 | 0.004 | 0.004 | 0.13 | — | — |

TABLE 3-continued

| Sample | Chemical Components (wt %) | | | | | | | | |
|---|---|---|---|---|---|---|---|---|---|
| No. | C | Mn | Cr | Mo | S | P | O | Ni | Cu |
| R | 0.007 | 0.03 | 1.00 | 0.07* | 0.004 | 0.004 | 0.13 | — | — |
| S | 0.007 | 0.03 | 1.01 | 2.70* | 0.005 | 0.005 | 0.13 | — | — |
| T | 0.007 | 0.03 | 1.02 | 0.30 | 0.020* | 0.004* | 0.13 | — | — |
| U | 0.005 | 0.03 | 1.00 | 0.31 | 0.004 | 0.021* | 0.13 | — | — |
| V | 0.006 | 0.03 | 1.01 | 0.31 | 0.004 | 0.005 | 0.31* | — | — |
| W | 0.006 | 0.03 | 1.03 | 0.30 | 0.004 | 0.005 | 0.14 | 2.6* | — |
| X | 0.005 | 0.03 | 0.99 | 0.30 | 0.005 | 0.005 | 0.14 | — | 2.7* |

TABLE 4-1

| Sample | Chemical Components of Sintered Body (wt %) | | | | | | | | | Tesnile Strength | Fatigue Strength | Impact Strength (Kgf · m/ | |
|---|---|---|---|---|---|---|---|---|---|---|---|---|---|
| No. | C | Mn | Cr | Mo | S | P | O | Ni | Cu | (Kgf/mm$^2$) | (Kgf/mm$^2$) | mm$^2$) | Remarks |
| A1 | 0.81 | 0.03 | 1.00 | 0.30 | 0.003 | 0.002 | 0.12 | — | — | 101 | 39 | 2.6 | Inventive Example |
| B1 | 0.81 | 0.08 | 1.01 | 0.31 | 0.003 | 0.002 | 0.11 | — | — | 96 | 36 | 2.5 | Inventive Example |
| C1 | 0.81 | 0.03 | 0.61 | 0.30 | 0.002 | 0.003 | 0.12 | — | — | 82 | 35 | 3.2 | Inventive Example |
| D1 | 0.82 | 0.03 | 2.61 | 0.31 | 0.003 | 0.003 | 0.12 | — | — | 93 | 35 | 2.9 | Inventive Example |
| E1 | 0.81 | 0.04 | 1.02 | 0.90 | 0.002 | 0.002 | 0.10 | — | — | 91 | 36 | 2.4 | Inventive Example |
| F1 | 0.80 | 0.03 | 0.99 | 1.50 | 0.003 | 0.002 | 0.12 | — | — | 83 | 35 | 2.1 | Inventive Example |
| G1 | 0.80 | 0.03 | 0.02 | 0.30 | 0.008 | 0.002 | 0.10 | — | — | 95 | 36 | 2.9 | Inventive Example |
| H1 | 0.81 | 0.03 | 1.02 | 0.30 | 0.002 | 0.008 | 0.12 | — | — | 94 | 36 | 2.8 | Inventive Example |
| I1 | 0.81 | 0.04 | 1.00 | 0.30 | 0.002 | 0.002 | 0.04 | — | — | 110 | 41 | 3.0 | Inventive Example |
| J1 | 0.80 | 0.04 | 1.00 | 0.31 | 0.003 | 0.002 | 0.12 | 0.4 | — | 105 | 39 | 3.2 | Inventive Example |
| K1 | 0.82 | 0.03 | 1.00 | 0.30 | 0.003 | 0.003 | 0.12 | 2.2 | — | 106 | 39 | 2.5 | Inventive Example |
| L1 | 0.80 | 0.04 | 0.99 | 0.31 | 0.003 | 0.002 | 0.11 | — | 0.6 | 104 | 38 | 3.0 | Inventive Example |
| M1 | 0.80 | 0.03 | 1.01 | 0.30 | 0.002 | 0.002 | 0.12 | — | 2.2 | 105 | 39 | 2.6 | Inventive Example |
| N1 | 0.80 | 0.03 | 1.02 | 0.30 | 0.002 | 0.002 | 0.12 | 0.7 | 0.7 | 110 | 40 | 2.9 | Inventive Example |
| O1 | 0.80 | *0.12 | 1.01 | 0.31 | 0.003 | 0.002 | 0.12 | — | — | 71 | 27 | 1.7 | Comparative Example |
| P1 | 0.80 | 0.03 | *0.41 | 0.30 | 0.002 | 0.003 | 0.12 | — | — | 45 | 26 | 3.5 | Comparative Example |
| Q1 | 0.81 | 0.03 | *3.52 | 0.30 | 0.003 | 0.003 | 0.11 | — | — | 73 | 23 | 0.9 | Comparative Example |
| R1 | 0.81 | 0.03 | 1.00 | *0.07 | 0.002 | 0.002 | 0.10 | — | — | 69 | 22 | 2.7 | Comparative Example |
| S1 | 0.82 | 0.03 | 1.01 | *2.70 | 0.003 | 0.002 | 0.10 | — | — | 55 | 23 | 0.9 | Comparative Example |
| T1 | 0.80 | 0.03 | 1.02 | 0.30 | *0.018 | 0.002 | 0.12 | — | — | 75 | 24 | 1.2 | Comparative Example |
| U1 | 0.80 | 0.03 | 1.00 | 0.31 | 0.002 | *0.020 | 0.12 | — | — | 73 | 24 | 0.9 | Comparative Example |
| V1 | 0.80 | 0.03 | 1.01 | 0.31 | 0.002 | 0.002 | *0.21 | — | — | 58 | 22 | 1.1 | Comparative Example |

TABLE 4-1-continued

| Sample | Chemical Components of Sintered Body (wt %) | | | | | | | | | Tesnile Strength | Fatigue Strength | Impact Strength (Kgf · m/ | |
|---|---|---|---|---|---|---|---|---|---|---|---|---|---|
| No. | C | Mn | Cr | Mo | S | P | O | Ni | Cu | (Kgf/mm²) | (Kgf/mm²) | mm²) | Remarks |
| W1 | 0.81 | 0.03 | 1.03 | 0.30 | 0.002 | 0.002 | 0.10 | *2.6 | — | 62 | 25 | 1.3 | Comparative Example |
| X1 | 0.80 | 0.03 | 0.99 | 0.30 | 0.003 | 0.003 | 0.10 | — | *2.7 | 65 | 24 | 1.0 | Comparative Example |

*Outside the scope of the invention.

EXAMPLE 3

Zinc stearate powder, being 1 wt %, was respectively added to the alloy steel powders shown in Table 3, followed by compacting to obtain a green compact having a packing density of 7.0 g/cm². These compacts were sintered in vacuum under conditions of 1250° C. and 60 minutes, followed by carburizing treatment (carbon potential of 0.7%) at 920° C. for 90 minutes, oil quenching and tempering at 150° C. of 60 minutes. The resultant sintered and curburized bodies were subjected to measurements of tensile strength, fatigue strength and Sharpy impact value. The test results are shown in Table 5. As will be apparent from Table 5, the examples of the invention exhibit good tensile strength, fatigue strength and Sharpy impact value of not lower than 125 kgf/mm², not lower than 45 kgf/mm² and not lower than 1.0 kgf·m/cm².

TABLE 5

| Sample | Chemical Components of Sintered Body (wt %) | | | | | | | | | Tensile Strength | Fatigue Strength | Impact Strength (Kgf · m/ | |
|---|---|---|---|---|---|---|---|---|---|---|---|---|---|
| No. | C | Mn | Cr | Mo | S | P | O | Ni | Cu | (Kgf/mm²) | (Kgf/mm²) | mm²) | Remarks |
| A2 | 0.34 | 0.03 | 1.00 | 0.30 | 0.003 | 0.002 | 0.10 | — | — | 138 | 52 | 1.5 | Inventive Example |
| B2 | 0.32 | 0.08 | 1.01 | 0.31 | 0.002 | 0.003 | 0.12 | — | — | 135 | 51 | 1.3 | Inventive Example |
| C2 | 0.35 | 0.03 | 0.61 | 0.30 | 0.003 | 0.002 | 0.13 | — | — | 125 | 46 | 1.6 | Inventive Example |
| D2 | 0.40 | 0.03 | 2.62 | 0.31 | 0.003 | 0.003 | 0.09 | — | — | 130 | 50 | 1.4 | Inventive Example |
| E2 | 0.36 | 0.04 | 1.02 | 0.90 | 0.002 | 0.002 | 0.12 | — | — | 136 | 53 | 1.4 | Inventive Example |
| F2 | 0.38 | 0.03 | 0.99 | 1.50 | 0.002 | 0.002 | 0.11 | — | — | 136 | 53 | 1.1 | Inventive Example |
| G2 | 0.37 | 0.03 | 0.02 | 0.30 | 0.007 | 0.002 | 0.10 | — | — | 135 | 52 | 1.5 | Inventive Example |
| H2 | 0.31 | 0.03 | 1.02 | 0.30 | 0.002 | 0.007 | 0.11 | — | — | 134 | 51 | 1.4 | Inventive Example |
| I2 | 0.30 | 0.04 | 1.00 | 0.30 | 0.002 | 0.002 | 0.02 | — | — | 140 | 55 | 1.7 | Inventive Example |
| J2 | 0.40 | 0.04 | 1.00 | 0.31 | 0.003 | 0.002 | 0.12 | 0.4 | — | 130 | 50 | 1.6 | Inventive Example |
| K2 | 0.35 | 0.03 | 1.00 | 0.30 | 0.002 | 0.002 | 0.11 | 2.2 | — | 131 | 49 | 1.3 | Inventive Example |
| L2 | 0.36 | 0.04 | 0.99 | 0.31 | 0.003 | 0.003 | 0.13 | — | 0.6 | 130 | 49 | 1.5 | Inventive Example |
| M2 | 0.36 | 0.03 | 1.01 | 0.30 | 0.002 | 0.003 | 0.10 | — | 2.2 | 131 | 48 | 1.3 | Inventive Example |
| N2 | 0.31 | 0.03 | 1.02 | 0.30 | 0.002 | 0.002 | 0.10 | 0.7 | 0.7 | 145 | 54 | 1.4 | Inventive Example |
| O2 | 0.35 | *0.12 | 1.01 | 0.31 | 0.002 | 0.002 | 0.10 | — | — | 118 | 40 | 0.7 | Comparative Example |
| P2 | 0.41 | 0.03 | *0.41 | 0.30 | 0.002 | 0.002 | 0.11 | — | — | 113 | 38 | 1.5 | Comparative Example |
| Q2 | 0.36 | 0.03 | *3.52 | 0.30 | 0.002 | 0.002 | 0.13 | — | — | 112 | 37 | 0.4 | Comparative Example |
| R2 | 0.34 | 0.03 | 1.00 | *0.07 | 0.002 | 0.002 | 0.09 | — | — | 116 | 39 | 1.3 | Comparative Example |
| S2 | 0.31 | 0.03 | 1.01 | *2.70 | 0.002 | 0.003 | 0.09 | — | — | 115 | 38 | 0.4 | Comparative |

TABLE 5-continued

| Sample | Chemical Components of Sintered Body (wt %) | | | | | | | | | Tensile Strength | Fatigue Strength | Impact Strength (Kgf · m/ | |
|---|---|---|---|---|---|---|---|---|---|---|---|---|---|
| No. | C | Mn | Cr | Mo | S | P | O | Ni | Cu | (Kgf/mm²) | (Kgf/mm²) | mm²) | Remarks |
| T2 | 0.30 | 0.03 | 1.02 | 0.30 | *0.018 | 0.003 | 0.11 | — | — | 113 | 37 | 0.3 | Example Comparative Example |
| U2 | 0.39 | 0.03 | 1.00 | 0.31 | 0.003 | *0.020 | 0.13 | — | — | 112 | 35 | 0.3 | Comparative Example |
| V2 | 0.37 | 0.03 | 1.01 | 0.31 | 0.003 | 0.002 | *0.21 | — | — | 111 | 36 | 0.5 | Comparative Example |
| W2 | 0.37 | 0.03 | 1.03 | 0.30 | 0.002 | 0.002 | 0.11 | *2.6 | — | 113 | 37 | 0.5 | Comparative Example |
| X2 | 0.37 | 0.03 | 0.99 | 0.30 | 0.002 | 0.003 | 0.09 | — | *2.7 | 115 | 35 | 0.5 | Comparative Example |

*Outside the scope of the invention.

EXAMPLE 4

Graphite powder, being 0.1–1.3 wt % and 1 wt % of zinc stearate powder were added to the alloy steel powder Sample No. A in Table 3, followed by compacting to obtain green compacts having a density of 7.0 g/cm$^3$. These compacts were sintered in 90% $N_2$-10% $H_2$ under conditions of 1250° C. and 60 minutes, followed by cooling at a cooling rate of 20° C./minute. The resultant sintered bodies were subjected to measurements of tensile strength, fatigue strength and Sharpy impact value. The test results are shown in Table 6. As will be apparent from Table 6, the sintered bodies in the examples of the invention exhibit good tensile strength, fatigue strength and Sharpy impact value of not lower than 80 kgf/mm$^2$, not lower than 35 kgf/mm$^2$ and Sharpy value of not lower than 2.0 kgf·m/cm$^2$.

EXAMPLE 5

Alloy powders were prepared from molten steel having different chemical components according to a water-atomizing method. These powders were subjected to chemical analysis after finished reduction with the results shown in Table 7. Graphite, being 0.8% and 1% of zinc stearate were added to the alloy steel powders of Table 7, respectively, followed by compacting to obtain a green compact having a density of 7.0 g/cm$^3$. These compacts were sintered in 90% $N_2$-10% $H_2$ under conditions of 1250° C. and 60 minutes, followed by cooling at a cooling rate of 60° C./minute. The sintered bodies obtained after the cooling were subjected to measurement of tensile strength. The results are shown in Table 7. As will be apparent from Table 7, the high strength is attained within the compositional range of the alloy steels of the invention.

TABLE 6

| Sample | Chemical Components of Sintered Body (wt %) | | | | | | | | | Tensile Strength | Fatigue Strength | Impact Strength (Kgf · m/ | |
|---|---|---|---|---|---|---|---|---|---|---|---|---|---|
| No. | C | Mn | Cr | Mo | S | P | O | Ni | Cu | (Kgf/mm²) | (Kgf/mm²) | mm²) | Remarks |
| A3 | 0.31 | 0.03 | 1.00 | 0.30 | 0.002 | 0.002 | 0.14 | — | — | 81 | 36 | 3.6 | Inventive Example |
| A4 | 0.64 | 0.03 | 1.00 | 0.30 | 0.002 | 0.002 | 0.13 | — | — | 100 | 38 | 3.1 | Inventive Example |
| A5 | 1.05 | 0.03 | 1.00 | 0.30 | 0.002 | 0.002 | 0.10 | — | — | 85 | 37 | 2.6 | Inventive Example |
| A6 | *0.15 | 0.03 | 1.00 | 0.30 | 0.002 | 0.002 | 0.14 | — | — | 32 | 27 | 3.9 | Comparative Example |
| A7 | 1.30 | 0.03 | 1.00 | 0.30 | 0.002 | 0.002 | 0.10 | — | — | 49 | 28 | 0.5 | Comparative Example |

*Outside the scope of the invention.

TABLE 7

| Sample No. | Chemical Components (wt %) C | Mn | Cr | Mo | O | Tensile Strength (Kgf/mm$^2$) | Remarks |
|---|---|---|---|---|---|---|---|
| A | 0.008 | 0.03 | 1.00 | 0.30 | 0.07 | 119 | Inventive Sample |
| B | 0.009 | 0.07 | 0.99 | 0.32 | 0.06 | 105 | Inventive Example |
| C | 0.007 | 0.03 | 0.60 | 0.30 | 0.07 | 106 | Inventive Sample |
| D | 0.007 | 0.03 | 1.40 | 0.31 | 0.08 | 112 | Inventive Sample |
| E | 0.008 | 0.03 | 1.10 | 0.90 | 0.07 | 110 | Inventive Sample |
| F | 0.006 | 0.03 | 0.99 | 1.49 | 0.08 | 104 | Inventive Sample |
| G | 0.008 | *0.12 | 0.99 | 0.30 | 0.08 | 88 | Comparative Example |
| H | 0.006 | *0.20 | 1.10 | 0.31 | 0.07 | 75 | Comparative Example |
| I | 0.008 | 0.03 | *0.40 | 0.30 | 0.08 | 90 | Comparative Example |
| J | 0.007 | 0.04 | *3.10 | 0.30 | 0.06 | 91 | Comparative Example |
| K | 0.009 | 0.04 | 1.02 | *0.07 | 0.08 | 85 | Comparative Example |
| L | 0.008 | 0.03 | 1.00 | *2.50 | 0.08 | 80 | Comparative Example |

*Outside the scope of the invention.

EXAMPLE 6

Graphite, being 0.8%, and 1% of zinc stearate were added to the alloy steel powder No. A shown in Table 7 under mixing, followed by compacting to obtain green compacts having a density of 7.0 g/cm$^3$. These compacts were, respectively, sintered in 75% $H_2$-25% $N_2$ under conditions of 1250° C. and 60 minutes, followed by cooling at different cooling rates.

The resultant sintered bodies were subjected to measurements of tensile strength and Sharpy impact value in the same manner as in the foregoing examples. The test results are shown in FIG. 1. As will be apparent from FIG. 1, the high strength (indicated by the symbol "○") of not lower than 95 kgf/mm$^2$ is obtained in the cooling rate range of 10°–200° C./minute and the Sharpy impact value (indicated by the symbol "●") became 2 kgf·m/cm$^2$.

EXAMPLE 7

Graphite, being 0.8% and 1% of zinc stearate were added to the alloy steel powder No. B shown in Table 7, followed by compacting to obtain green compacts having a density of 7.0 g/cm$^3$. These green compacts were, respectively, sintered in 75% $H_2$-25% $N_2$ under conditions using different sintering temperatures ranging 1000°–1300° C. for 60 minutes, followed by cooling at a cooling rate of 30° C./minute.

Figure 2:
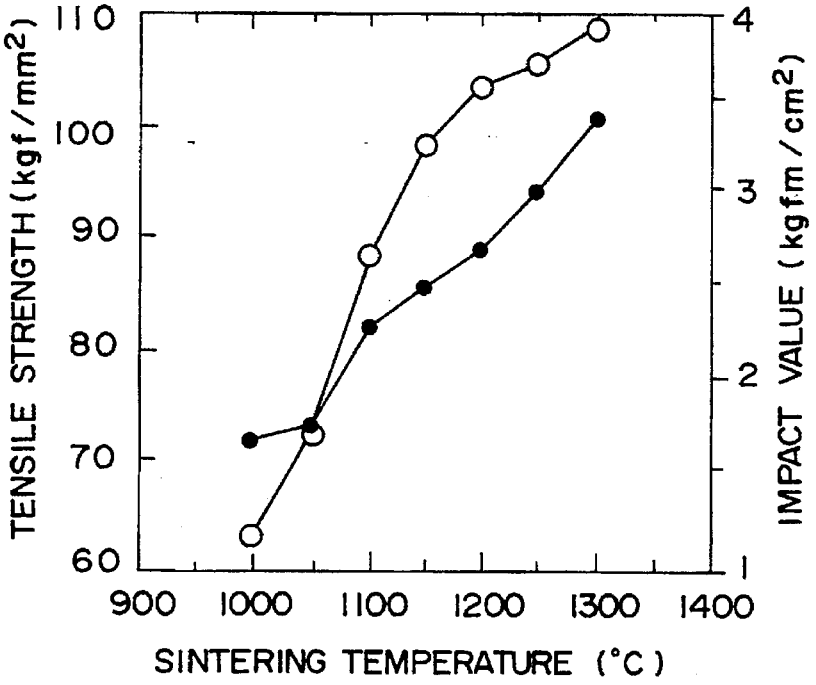
FIG. 2 is a characteristic view showing the relation between the tensile strength of sintered bodies and the sintering temperature.

The resultant sintered bodies were subjected to measurement of tensile strength and Sharpy impact value in the same manner as in Example 1. The test results are shown in FIG. 2. As will be apparent from FIG. 2, a high strength of not lower than 80 kgf/mm$^2$ was obtained at a sintering temperature not lower than 1100° C. with the Sharpy impact value being 2.3 kgf·m/cm$^2$.

EXAMPLE 8

Graphite, being 0.8% and 1% of zinc stearate were mixed with the alloy steel powders A, B, G and H indicated in Table 7, respectively, followed by compacting to obtain green compacts having a packing density of 6.8 g/cm$^3$. These compacts were sintered in 90% $N_2$-10% $H_2$ under conditions of 1150° C. and 30 minutes, followed by cooling at a cooling rate of 30°–120° C./minute.

Figure 3:
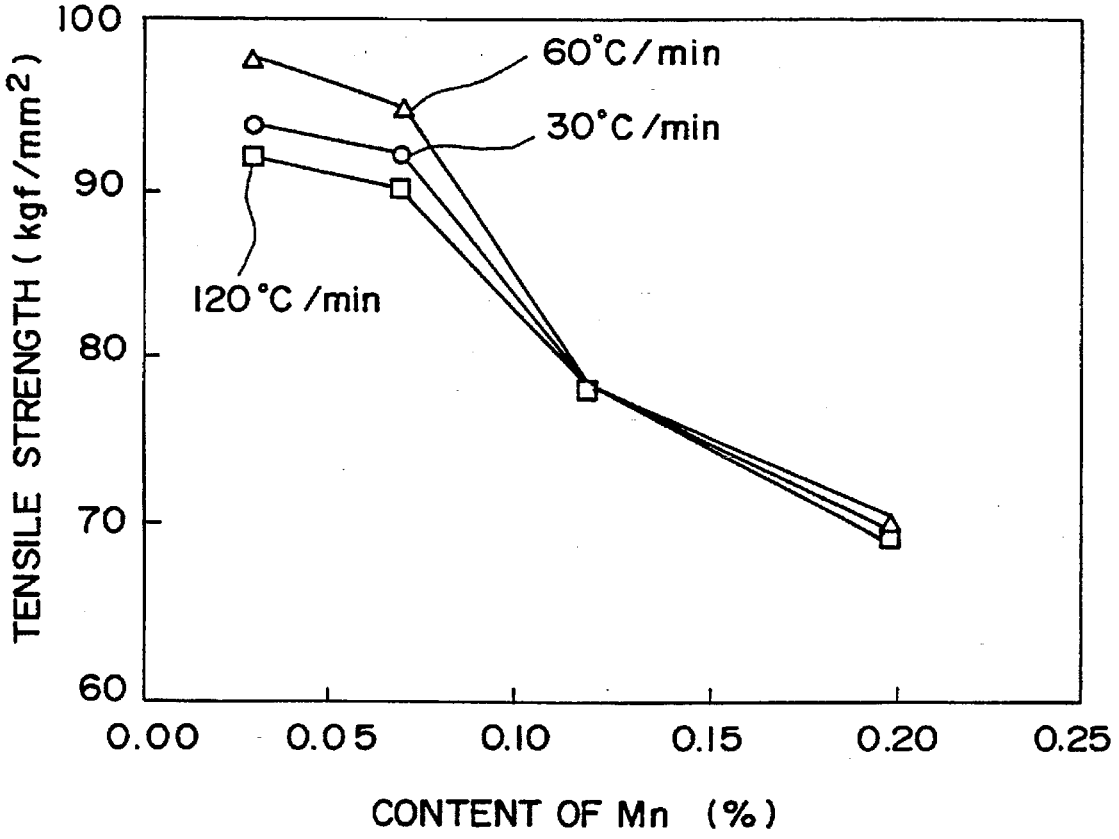
FIG. 3 is a characteristic view showing the relation between the tensile strength and the content of Mn in sintered bodies.

The resultant sintered bodies were subjected to measurement of tensile strength. The test results are shown in FIG. 3.

Within the range of the cooling rate of the invention, high strength was obtained when the content of Mn was not larger than 0.08%.

Industrial Applicability

The chemical composition of alloy steel powders, particularly, the contents of Mn, S and P, are optimized, so that the resultant sintered body has tensile strength, fatigue strength and toughness improved over those of prior art, ensuring enlarged utility for high strength sintered parts. Using a sintered body manufacturing method of the invention, high strength sintered bodies which will not be obtained in prior art unless heat treatments are effected after sintering can be obtained only by sintering. Thus, the supply of inexpensive sintered parts can be expected.

What is claimed is:

1. An alloy steel powder for sintered bodies having high strength, high fatigue strength and high toughness, which is characterized by comprising, by wt %, not larger than 0.1% of C, not larger than 0.08% of Mn, 0.5–3% of Cr, 0.1–2% of Mo, not larger than 0.01% of S, not larger than 0.01% of P, not larger than 0.2% of O, and the balance being inevitable impurities and Fe.

2. An alloy steel powder for sintered bodies having high strength, high fatigue strength and high toughness according to claim 1, characterized in that the content of Mo ranges 0.1–0.5%.

3. An alloy steel powder for sintered bodies having high strength, high fatigue strength and high toughness according to claim 1, characterized in that the content of Mn is not larger than 0.06%.

4. An alloy steel powder for sintered bodies having high strength, high fatigue strength and high toughness according to claim 1, characterized in that the content of Cr ranges 0.5–1.8%.

5. An alloy steel powder for sintered bodies having high strength, high fatigue strength and high toughness according to claim 1, characterized by further comprising one or more of 0.2–2.5% of Ni, 0.5–2.5% of Cu, 0.001–0.004% of V and 0.001–0.004% of Nb.

6. An alloy steel powder for sintered bodies having high strength, high fatigue strength and high toughness according to claim 1, characterized in that the alloy steel powder is prepared by water-atomization and then subjected to finishing reduction, in a vacuum or in hydrogen.

7. The alloy steel powder for sintered bodies having high strength, high fatigue strength and high toughness according to claim 5, characterized in that the alloy steel powder is prepared by water-atomization and then subjected to finishing reduction in a vacuum or in hydrogen.

8. A sintered body having high strength, high fatigue strength and high toughness, characterized by comprising, by wt %, 0.2–1.2% of C, not larger than 0.08% of Mn, 0.5–3% of Cr, 0.1–2% of Mo, not larger than 0.01% of S, not larger than 0.01% of P, not larger than 0.2% of O.

9. A sintered body having high strength, high fatigue strength and high toughness according to claim 8, characterized in that the content of Mo ranges 0.1–0.5%.

10. A sintered body having high strength, high fatigue strength and high toughness according to claim 7, characterized in that the content of Mn is not larger than 0.06%.

11. A sintered body having high strength, high fatigue strength and high toughness according to claim 8, characterized in that the content of Cr ranges 0.5–1.8%.

12. A sintered body having high strength, high fatigue strength and high toughness according to claim 8, further comprising one or more of 0.2–2.5% of Ni, 0.5–2.5% of Cu, 0.001–0.004% of Nb and 0.001–0.004% of V.

13. A sintered body having high strength, high fatigue strength and high toughness according to claim 8, characterized in that the sintered body has a structure made primarily of fine pearlite.

14. The sintered body having high strength, high fatigue strength and high toughness according to claim 12, characterized in that the sintered body has a structure made primarily of fine pearlite.

15. A method for manufacturing a sintered body having high strength, high fatigue strength and high toughness, comprising mixing 0.3–1.2% of graphite powder and a lubricant with an alloy steel powder for sintered bodies containing, by wt %, not larger than 0.1% of C, not larger than 0.08% of Mn, 0.5–3% of Cr, 0.1–2% of Mo, not larger than 0.01% of S, not larger than 0.01% of P, not larger than 0.2% of O, and the balance being inevitable impurities and Fe, and subjecting the mixture to compacting and sintering.

16. A method for manufacturing a sintered body having high strength, high fatigue strength and high toughness according to claim 15, characterized in that the mixture is sintered at 1100°–1300° C. and immediately cooled at a rate of 10°–200° C./minute.

17. The method for manufacturing a sintered body having high strength, high fatigue strength and high toughness according to claim 15, wherein said sintered bodies further comprise one or more of 0.2–2.5% of Ni, 0.5–2.5% of Cu, 0.001–0.004% of V and 0.001–0.004% of Nb.

18. The method for manufacturing a sintered body having high strength, high fatigue strength and high toughness according to claim 17, characterized in that the alloy steel powder is prepared by water-atomization and then subjected to finishing reduction in a vacuum or in hydrogen.

19. The method for manufacturing a sintered body having high strength, high fatigue strength and high toughness according to claim 15, characterized in that the alloy steel powder is prepared by water-atomization and then subjected to finishing reduction in a vacuum or in hydrogen.

20. The method for manufacturing a sintered body having high strength, high fatigue strength and high toughness according to claim 16, wherein said sintered bodies further comprise one or more of 0.2–2.5% of Ni, 0.5–2.5% of Cu, 0.001–0.004% of V and 0.001–0.004% of Nb.

21. The method for manufacturing a sintered body having high strength, high fatigue strength and high toughness according to claim 16, characterized in that the alloy steel powder is prepared by water-atomization and then subjected to finishing reduction in a vacuum or in hydrogen.

22. The method for manufacturing a sintered body having high strength, high fatigue strength and high toughness according to claim 16, characterized by using an alloy steel powder that contains one or more of 0.2–2.5% of Ni, 0.5–2.5% of Cu, 0.001–0.004% of V and 0.001–0.004% of Nb, and that is prepared by water-atomization and then is subjected to finishing reduction in a vacuum or in hydrogen.

23. A method for manufacturing a sintered body having high strength, high fatigue strength and high toughness, comprising mixing not larger than 0.6% of graphite powder and a lubricant with an alloy steel powder for sintered bodies containing, by wt %, not larger than 0.1% of C, not larger than 0.08% of Mn, 0.5–3% of Cr, 0.1–2% of Mo, not larger than 0.01% of S, not larger than 0.01% of P, not larger than 0.2% of O, and the balance being inevitable impurities and Fe, subjecting the mixture to compacting and sintering, and carburizing the sintered body.

24. A method for manufacturing a sintered body having high strength, high fatigue strength and high toughness according to claim 23, characterized in that the carburizing treatment is effected at a temperature of 850°–950° C. at a carbon potential of 0.7–1.1%.

25. The method for manufacturing a sintered body having high strength, high fatigue strength and high toughness according to claim 23, wherein said sintered bodies further comprise one or more of 0.2–2.5% of Ni, 0.5–2.5% of Cu, 0.001–0.004% of V and 0.001–0.004% of Nb.

26. The method for manufacturing a sintered body having high strength, high fatigue strength and high toughness according to claim 23, characterized by using an alloy steel powder that is prepared by water-atomization and then subjected to finishing reduction in a vacuum or in hydrogen.

27. The method for manufacturing a sintered body having high strength, high fatigue strength and high toughness according to claim 25, characterized by using an alloy steel powder that is prepared by water-atomization and then subjected to finishing reduction in a vacuum or in hydrogen.

28. The method for manufacturing a sintered body having high strength, high fatigue strength and high toughness according to claim 24, wherein said sintered bodies further comprise one or more of 0.2–2.5% of Ni, 0.5–2.5% of Cu, 0.001–0.004% of V and 0.001–0.004% of Nb.

29. The method for manufacturing a sintered body having high strength, high fatigue strength and high toughness according to claim 24, characterized by using an alloy steel powder that is prepared by water-atomization and then subjected to finishing reduction in a vacuum or in hydrogen.

30. The method for manufacturing a sintered body having high strength, high fatigue strength and high toughness according to claim 24, characterized by using an alloy steel powder that contains one or more of 0.2–2.5% of Ni, 0.5–2.5% of Cu, 0.001–0.004% of V and 0.001–0.004% of Nb, and that is prepared by water-atomization and then is subjected to finishing reduction in a vacuum or in hydrogen.

* * * * *